US006796382B2

(12) United States Patent
Kaimart

(10) Patent No.: US 6,796,382 B2
(45) Date of Patent: Sep. 28, 2004

(54) FIRE EXTINGUISHING BALL

(75) Inventor: Woradech Kaimart, Banglamung (TH)

(73) Assignees: Siam Safety Premier Co., Ltd., Chonburi (TH); Siam Safety Empire Co., Ltd., Chonburi (TH)

( * ) Notice: Subject to any disclaimer, the term of this patent is extended or adjusted under 35 U.S.C. 154(b) by 0 days.

(21) Appl. No.: 09/895,246

(22) Filed: Jul. 2, 2001

(65) Prior Publication Data

US 2003/0006046 A1 Jan. 9, 2003

(51) Int. Cl.[7] ..... A62C 35/02; A62C 13/62; A62C 3/00

(52) U.S. Cl. ..... 169/43; 169/28; 169/35; 169/36; 169/26

(58) Field of Search ..... 169/35, 36, 26, 169/28, 43

(56) References Cited

U.S. PATENT DOCUMENTS

| | | | | | |
|---|---|---|---|---|---|
| 798,623 | A | * | 9/1905 | Poole et al. | 169/36 |
| 870,479 | A | * | 11/1907 | Stanley | 109/32 |
| 1,458,972 | A | * | 6/1923 | Braude | 169/36 |
| 1,482,522 | A | * | 2/1924 | Morriss | 169/28 |
| 1,565,036 | A | * | 12/1925 | Tank | 169/26 |
| 2,306,321 | A | * | 12/1942 | Roberts | 102/369 |
| 2,759,547 | A | * | 8/1956 | Zabriskie | 169/35 |
| 2,873,806 | A | * | 2/1959 | Bittner | 102/368 |
| 3,446,287 | A | | 5/1969 | Hook | |
| 3,833,063 | A | * | 9/1974 | Williams | 169/28 |
| 3,980,139 | A | | 9/1976 | Kirk | |
| 4,964,469 | A | | 10/1990 | Smith | |
| 5,232,053 | A | | 8/1993 | Gillis | |
| 5,588,493 | A | | 12/1996 | Spector et al. | |
| 5,894,891 | A | | 4/1999 | Rosenstock et al. | |
| 5,894,892 | A | | 4/1999 | Huang | |
| 6,012,531 | A | | 1/2000 | Ryan | |
| 6,050,343 | A | * | 4/2000 | Garcia Calvo | 169/36 |
| 6,056,063 | A | | 5/2000 | Hung | |

* cited by examiner

*Primary Examiner*—Robin O. Evans
(74) *Attorney, Agent, or Firm*—Sterne, Kessler, Goldstein & Fox, P.L.L.C.

(57) ABSTRACT

A fire extinguishing device of the explosive type is disclosed for use in interior or localized exterior conflagrations, wherein the force of detonation of the device is minimalized through the use of low density/low mass components; no part of the device having sufficient mass or density to typically constitute a safety hazard as flying debris, nor be dangerous in concussive shock due the explosive burst. The present invention is composed of a lightweight casing of rigid plastic foam or other suitably frangible material, with an abrasion-resistant, thin plastic, protective, exterior sheathing. Within the internal cavity of the device, a low explosive yield detonator is located at or near the center of mass, and is actuated by fuse cord(s) extending from the detonator, the end(s) of which extend(s) from the interior detonator to a mounting at or near the exterior surface. The interior volume of the hollow casing is chargeable, through variations in internal configuration, with a variety of fire-retardant chemical agents, including dry powders, two-part reactants, liquid components or others, singly or in combination.

23 Claims, 5 Drawing Sheets

FIRE EXTINGUISHING BALL

CROSS-REFERENCE TO RELATED APPLICATIONS

| | | | |
|---|---|---|---|
| 3,446,287 | May 1969 | Hook | 169/28 |
| 3,980,139 | September 1976 | Kirk | 169/28 |
| 4,964,469 | February 1990 | Smith | 169/28 |
| 5,232,053 | August 1993 | Gillis | 169/28 |
| 5,588,493 | December 1996 | Spector et al | 169/28 |
| 6,012,531 | January 2000 | Ryan | 169/28 |
| 6,056,063 | May 2000 | Hung | 169/28 |

STATEMENT REGARDING FEDERALLY SPONSORED RESEARCH OR DEVELOPMENT

[Not Applicable]

REFERENCE TO A MICROFICHE APPENDIX

[Not Applicable]

BACKGROUND OF THE INVENTION

1. Field of the Invention

The invention relates to fire extinguishing devices. In particular, this invention relates to a device that disperses fire-fighting chemical agents, both wet and dry types, through the use of an explosive force.

2. Background of Prior Art

Fire-fighting devices in general use at present, are subject to numerous limiting factors with respect to their cost of acquisition, placement, storage, deployment for fire-fighting—or fire suppression—and other factors. By their nature, they may require periodic inspection by qualified, knowledgeable persons, training or esoterically detailed familiarity in their use, are typically bulky and/or require, as centralized sensing and extinguishing systems, extensive, expensive installation to afford the protection they are designed to provide.

Small fire safety devices, such as the common pressurized dry chemical extinguisher, are relatively heavy, due to the prerequisite construction of the their pressurized containers. Their weight, bulk and relative complexity, adds to the cost of manufacture, and therefore, theoretically, their cost of acquisition. In use, their directed stream of chemical spray requires judgment and forethought, and therefore, a fully conscious and cognizant user whose mental faculties have not been impaired by smoke, heat, mental stress or panic.

Sprinkler systems, are subject to high installation costs, and may fail to effectively fight fires due to limited water supplies, sedimentary clogging of water supply piping, or failure to install sprinkler heads with sufficient coverage areas throughout an edifice, among other factors.

A drawback to nearly any fixed installation of fire-fighting equipment such as fire hoses, sprinklers, or the device of U.S. Pat. No. 6,056,063 to Hung, is that they are often installed with less than complete coverage area for the full extent of the interior space they were installed to protect, due to limits of the dispersal pattern from the fixed mounting, or physical obstructions to retardant discharge. An example being a single dispersal unit, such as a water sprinkler head, in the center of a hotel room, which if actuated due to fire, would have a dispersal pattern which might not reach all corners of an irregularly shaped room, such irregularities commonly including short entrance corridors and closets blinded from the sprinkler head by corners, etc.

Thus, the present invention is designed as a product which is versatile in installation mounting, i.e., mountable in a simple holder on walls, desk, counter or table surfaces, or elsewhere, and be able to self-actuate when situated as thus, yet can be lifted out of its holder and deployed manually, should any occupant of the room or area deem appropriate, and be conscious and capable of doing so.

Explosive devices for fire-fighting purposes, in prior art, have often demonstrated high efficiency in extinguishing localized blazes, but have shown limitations, again, in cost and the relative sophistication of their design impacting complexity in manufacturing process. Also their methods of storage, deployment and/or use, such designs may be seen to require expert use, inhibiting broad public acceptance. Again, as mentioned previously, dispersal patterns of the fire extinguishing chemicals from some explosive fire-fighting devices may, in some cases, be less than uniform or ideal. Two other important detractions to explosively dispersed chemical fire-fighting devices are the force of detonation experienced with some, and subsequent flying debris from even some minute parts of such devices despite frangible casings, therefore being, therein, safety hazards unto themselves.

In nearly all prior art, be they of explosive type or other means of delivery, the cost of manufacture and/or installation, and therefore the cost of purchase is a limiting factor to broad public demand; this factor being most acutely apparent in underdeveloped countries, and even in poorer communities of developed nations.

The bulk and subjective unsightliness of even the common dry chemical, pressurized tank fire extinguisher aesthetically limits their installation in many private dwellings worldwide. One does not typically find such devices mounted in living rooms, or guest reception areas, sometimes purely for aesthetic reasons.

Frequently, only one fire-extinguisher is maintained for the entirety of a private dwelling, and it may fail to work after lying dormant many years, due to its need of periodic inspection and maintenance by qualified personnel; something often overlooked by private owners. And with only one fire-fighting device deployed at some point within the dwelling, the possibility exists that a path to it may be blocked by flame and/or smoke, especially when a fire starts and spreads while the occupants are asleep.

The present invention is intended to overcome or lessen the above limitations in prior art.

BRIEF SUMMARY OF THE INVENTION

1. Object of the Invention

The object of this invention is to provide an inexpensive, compact and easily used device, which, while being of the explosive type, does not present any serious safety hazard in its actuation.

It is important to establish in this portion of the disclosure that the present invention is a single-use device, which is environmentally friendly in its basic construction, and leaves little more residue than the expended fire extinguishing/suppressant chemicals employed with the device, when actuated. No attempt is made to affect reusability in the device, because a reusable device requires components that can withstand the stresses of a remanufacturing process, add the need for a recycling infrastructure that can not only 'refill' the device, but also test and certify that the recycled device can perform again at the required level of protection or usefulness. This of course leads to the requirement that the reusable components must be sturdy enough not only for refilling/remanufacturing, but to be able to reliably perform for more than one use. These preconditions to a reusable device, especially with respect to a device upon which lives and property would depend, it is felt economically prejudices reusable containers or systems for general public use.

What is logically required in a low-cost, easily manufactured, effective fire-fighting device is, a low mass, inexpensively manufacturable containment vessel, with a maximum of fire-retardant chemical agent within such a device—viewed as a high relative percentage of weight/mass of the fire-fighting agent to the total weight of the complete functional unit—and a method of dispersal of the chemical agent by a rapid means, which in itself is lightweight, does not create bulk, is inexpensive and places few demands on the device container while the device is stored and unused. General public acceptance also requires other values, as well, those being that it is highly effective in its work, that it is intuitively easy to use, compact enough to be placed anywhere near at hand when needed, and that it be inexpensive.

Thus, the device disclosed herein is intended to have the following features—

- A simple, self-contained design, and of a construction whose physical integrity and ability to operate can be quickly surmised through visual inspection of its exterior by ordinary persons not highly versed in technical knowledge, and be—
- inexpensive and easily manufactured in nearly any country, worldwide;
- so intuitively simple in its use that even a confused or partially impaired user may employ it with little forethought;
- so innocuous in size and shape that it may be installed or stored in nearly any environment without esthetic objection;
- capable of actuation with or without human intervention, and if without, that upon detonation provides sufficient aural report to warn persons in the vicinity of the fire threat.

2. General Description

The present invention is an explosive, fire-fighting device comprised of three basic components, being— a) A frangible casing whose composition represents no threat as shrapnel,
b) Fire-fighting agents such as are commercially available, whether being either dry, wet, or of other form in single or multiple component combinations,
c) A detonating device with low explosive yield, insufficient to deliver a debilitating concussive shock to humans at even relatively close proximity to the device during actuation, preferably of a type lacking any constituent part with sufficient hardness, mass or density to constitute shrapnel-like hazard, and be commercially available and commonly found.

In the preferred embodiment, component a) is comprised of a low-density, rigid plastic foam molded to shape, which may be, but is not limited to, a sphere—comprising one hemispherical molded shape, where two of the same molded part form a complete sphere, which again, is not intended to limit the present invention to only one shape, nor exclude other possible configurations of the casing.

If the seam formed by the assembly of two such hemispheres together may be considered a latitudinal plane of reference, then at the polar regions of the component hemispheres, or other convenient point(s), small holes are located with adjacent exterior surface cavities through which small pyrotechnic fuse cords are protruded and laid flat in the aforementioned cavities. A round filler hole molded into the hemispheres at the joint between them suffices as an orifice for charging the device with the chemical fire-fighting agent(s) after assembly of the casing halves into a whole unit with the detonator already inside.

The wall thickness of a rigid foam casing has been found to be adequate at between 0.8–1.0 centimeter, for a device approximately fifteen centimeters in diameter. An adhesive compatible with the casing material may be employed in assembling the two casing halves, but is not essential.

Surrounding the assembled casing, as outer layers, are typically one or more layers of commonly available, moderate thickness, plastic shrink-wrap film. In the spherical exterior embodiment of this device, the first layer would be a wide band of the shrink-wrap film applied in a vertical orientation, crossing the poles of the sphere, holding secure the two hemispheres, as well as the filler plug, and also covering the fuse ends at the poles. This layer, after low temperature hot air is applied to the shrink-wrap film, covers most of the sphere. A second band, being the same part—in size, thickness and diameter—as the first layer, is applied latitudinally about the seam formed by the two assembled halves. When the second band is heat-contoured to the sphere, the layers together completely cover the exterior of the invention. The shrink-wrap film layer(s), no matter what the external shape of the device is, can provide the structural quality which typical low-density, rigid plastic foam materials for the casing lack, i.e., a tensile external 'skin' more resistant to surface abrasion. This sheathing also helps to make the invention highly water-resistant, where desired, with the additional modest application of silicone-based, or other, sealants in a few selected areas.

Component b) is the primary, and possibly secondary, fire-extinguishing agent. The choice of chemical agent is limited only to that the core chemical—meaning the chemical charge in a single walled version, or the inner core charge of the multi-walled version of the present invention—should be of the dry powder type, such as of commercially available ammonium phosphates or sodium carbonate types, or any other suitable fire-fighting chemical in dry powder form; otherwise the detonator must be impervious to the agent in any other physical form, or the detonator be isolated from the chemical agent through protective wrapping or coating.

The choice of chemical agent is determinable by availability, cost and intent to specialize a version of the present invention for a particular type of fire hazard.

Liquid or even gaseous agents at atmospheric pressure may otherwise be accommodated by adding them to the outer cavity, or cavities, of a multi-walled construction, with outer casing(s) essentially much the same construction as the inner casing, only larger. It has been found that even plain water affords a marked increase in fire-fighting efficacy as an instantaneous coolant, through misting, upon detonation of the device, though other commercially known, specialized liquid agents may provide higher, specialized efficiency.

Component c) is the detonator with fuse cords at either end. These common, commercially available pyrotechnic detonators are typically of the magnesium/aluminum powder-based type, and are chosen for wide availability, in sizes with only just enough explosive yield to burst the casing(s) of the device, and disperse the fire-extinguishing agents in an effective pattern.

A small, fifteen-centimeter diameter, single component, dry chemical device of this invention has been found to be capable of dispersing its chemical agent up to two meters, or more, from the point of detonation, in an omni-directional dispersal pattern—given the preferred spherical exterior configuration, and can effectively achieve effectively spontaneous dousing of flames within that radius for many types of fires, without the need of much explosive force. It has also been found that the force required to disperse dry powder chemical cores in a fifteen-centimeter diameter device of this invention will in most cases cause only slight temporary bruising to bystanders at a stand-off range of 0.5 meters or less, and be very unlikely to cause any permanent injury even if in direct contact with the device during detonation, depending on variations in actual construction and moderation in choice of detonator yield.

This is due to the fact that the container, or casing, of the invention is made from the foam frangible material with sheathing as previously disclosed. While this configuration is sturdy enough to sustain the physical integrity of the device against moderate external physical abuse, and permitting a long shelf life, the force required to shatter it from within and disperse its chemical agent(s) is not great.

BRIEF DESCRIPTION OF DRAWINGS

1. List of Drawings

Included in this disclosure are five drawings of the present invention, including certain modifications to the basic design. These drawings do depict all essential elements of the device, however, they are not intended to limit the external shape to only those shown.

Figure 1:
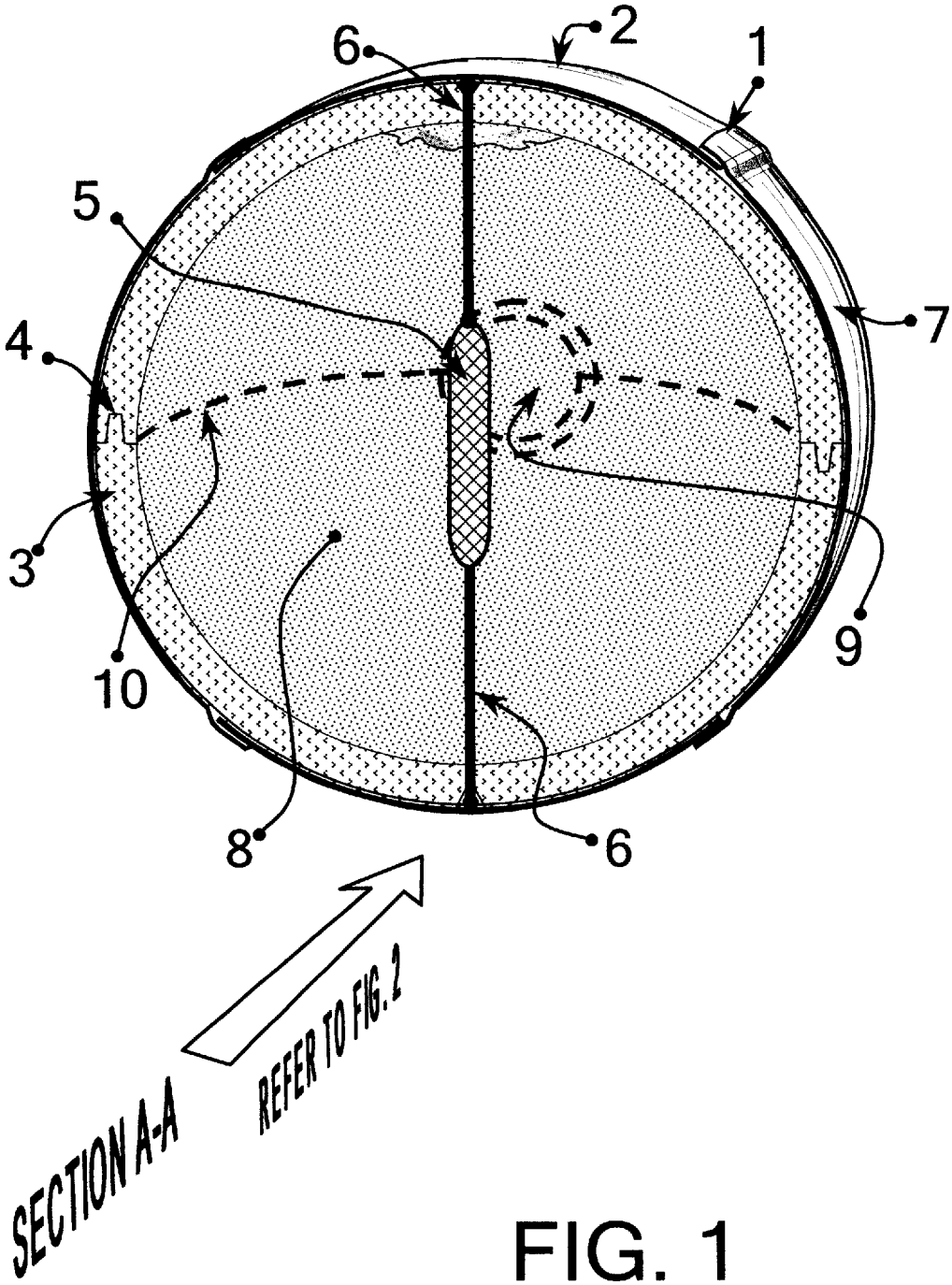
FIG. 1 depicts a cutaway sectional view of the fire-extinguishing device in perspective.
Figure 2:
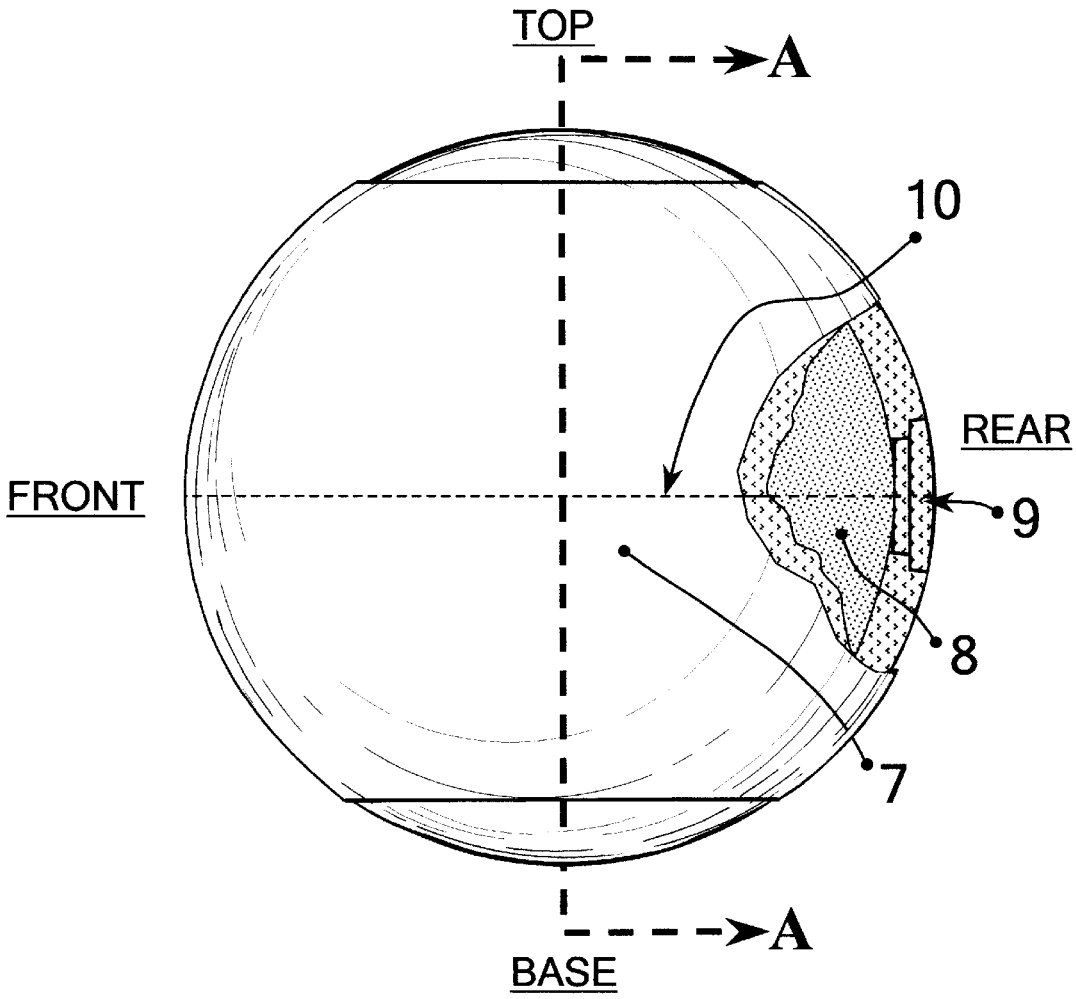
FIG. 2 is a view of the basic external shape version of this invention, and locates the plane of reference for the sectional view used in several other drawings.

2. List of Reference Numerals Employed in the Drawings

1.—Region of overlap between shrink-wrap plastic film layers
2.—Vertically (or 'longitudinally') bound shrink-wrap plastic film layer
3.—Frangible casing
4.—Tongue-and-groove joint cast into the rim of the hemispheres
5.—Detonator
6.—Fuse cord (at either end of detonator)
7.—Horizontally (or 'latitudinally') bound shrink-wrap plastic film layer
8.—Fire-extinguishing chemical agent filler
9.—Filler hole and fitted plug
10.—Seam between hemispherical casing halves
11.—Secondary fire-extinguishing chemical filler within outer cavity of double-walled modification of the basic design
12.—Spacer ring between inner and outer casings
13.—Molded-in polar locating nodes, double-walled modification
14.—Outer casing, double-walled modification

DETAILED DESCRIPTION OF THE INVENTION

To meet the prescribed specification in the Summary, the containment vessel, seen FIG. 1 and other drawings as 3, of the present invention utilizes lightweight, low density, rigid plastic foam as the preferred material, and specify among the current best choices, EPS (expanded polystyrene foam). Environmentally friendly, this material is molded into the required component shape, of which the preferred embodiment would require a hemisphere, because the sphere assembled from it is basic and efficient in terms of manufacture, the ratio of interior volume relative to surface area is highest, and thus the size of the device is minimized, as well as being that shape which results in the most evenly omni-directional dispersal pattern when utilized.

In a spherical exterior embodiment, half of the rim of each hemisphere could feature a tongue protrusion and matching groove 4 on the other half of the rim—or other joint features, excepting a small portion of the rim reserved for (half of) the filler hole and fitted plug 9, permitting a single molding to be used for both sides of the sphere with a secure joint between them 10.

The present invention is intended to be projected by hand—meaning tossed, rolled, dropped or otherwise delivered directly into the vicinity of a fire, upon which fuse cords 6 at either or both polar ends of the sphere would be ignited, subsequently activating the pyrotechnic detonator 5, whose explosive yield would shatter the foam casing and disperse the chemical agent(s) 8. This preferred embodiment is amongst the most economical solutions possible for the actuation of the device. This disclosure does not contend that the common paper or cardboard-wrapped fireworks pyrotechnic detonator is the only type which may be used, however, It is intended that, for general public use, the detonator chosen must be of a type constructed of materials with such low density and mass of constituent parts that they effectively disintegrate into minute, non-hazardous flying debris upon explosion of the detonator.

Assembly of the present invention from its component parts begins with threading one of the fuse cords 6 of the detonator 5 through the hole made for it in the plastic foam casing 3, and then cutting that cord off at such a length and inserting its end into a casing depression cavity for the fuse 6 tip such that the detonator 5 will be suspended in the approximate center of mass of the assembled device. The other fuse cord at the other end of the detonator is then likewise threaded through a hole in the base of the casing, and the two casing halves are pressed together and held in place by a tongue-and-groove joint 4, or other joint feature, whereafter the second fuse cord is likewise cut to length and embedded into a pre-molded depression cavity on the casing's surface.

A dry chemical fire-extinguishing/fire-suppressant agent 8 is then poured through the filler hole 9 into the casing until it is full, and the hole is then closed with a molded-to-fit plug. A pre-sized plastic shrink-wrap band 2 or 7—typically of PVC plastic, due to its lower heat requirement for shrinkage than polyolefin film—is then fitted to the casing 3 or 14. In the spherical embodiment, one shrink-wrap film band 2 would be fitted vertically (meaning that the centerline of the band would be oriented longitudinally), wherein the centerline of the circular shrink-wrap band should cross and cover the fuse cord 6 tips lying in cavities at the top and base of the assembly, as well as crossing the centerline of the filler plug 9 at the seam between the hemispheres 10, in this preferred configuration.

That single shrink-wrap band 2 would effectively constrain the entire assembly of a sphere into a bound and sealed unit, but would not ordinarily cover the sphere's entire surface, due to the maximum shrink ratio of typical plastic shrink-wrap film being usually insufficient for the edges of the shrink-wrap band to effectively reduce their contour under application of hot air to completely, and neatly, enclose the entire spherical surface. Thus, lacking a film with higher shrink ratio characteristics, the width of the shrink-wrap band is limited to that width which can be neatly contoured onto a spherical shape.

A second band 7 is then necessitated to the spherical assembly, this one latitudinally applied, i.e., fitted with the centerline of this band being co-located in a plane with the seam between the two hemispheres 10, and likewise heat-contoured to the sphere's surface with a hot-air blower or through a hot-air tunnel—as is industrially common—with an operating air temperature considerably below the ignition temperature of the fuse cords of the assembly. At this point, the basic assembly of the device is complete.

Minor refinements to this procedure can include the addition of modest amounts of a silicone-based or other sealer compatible with the composition of the casing and the shrink-wrap film, to make the casing seams, filler plug and fuse cord holes impervious to intrusion of moisture, over and above the protection afforded by the shrink-wrap film. This assembly process is simple and rapid enough that, given pre-molded casings, a workforce of ten unskilled workers, or less, is able to assemble hundreds of units per day by hand, making production of the present invention accessible to even quite remote and underdeveloped areas.

Figure 4:
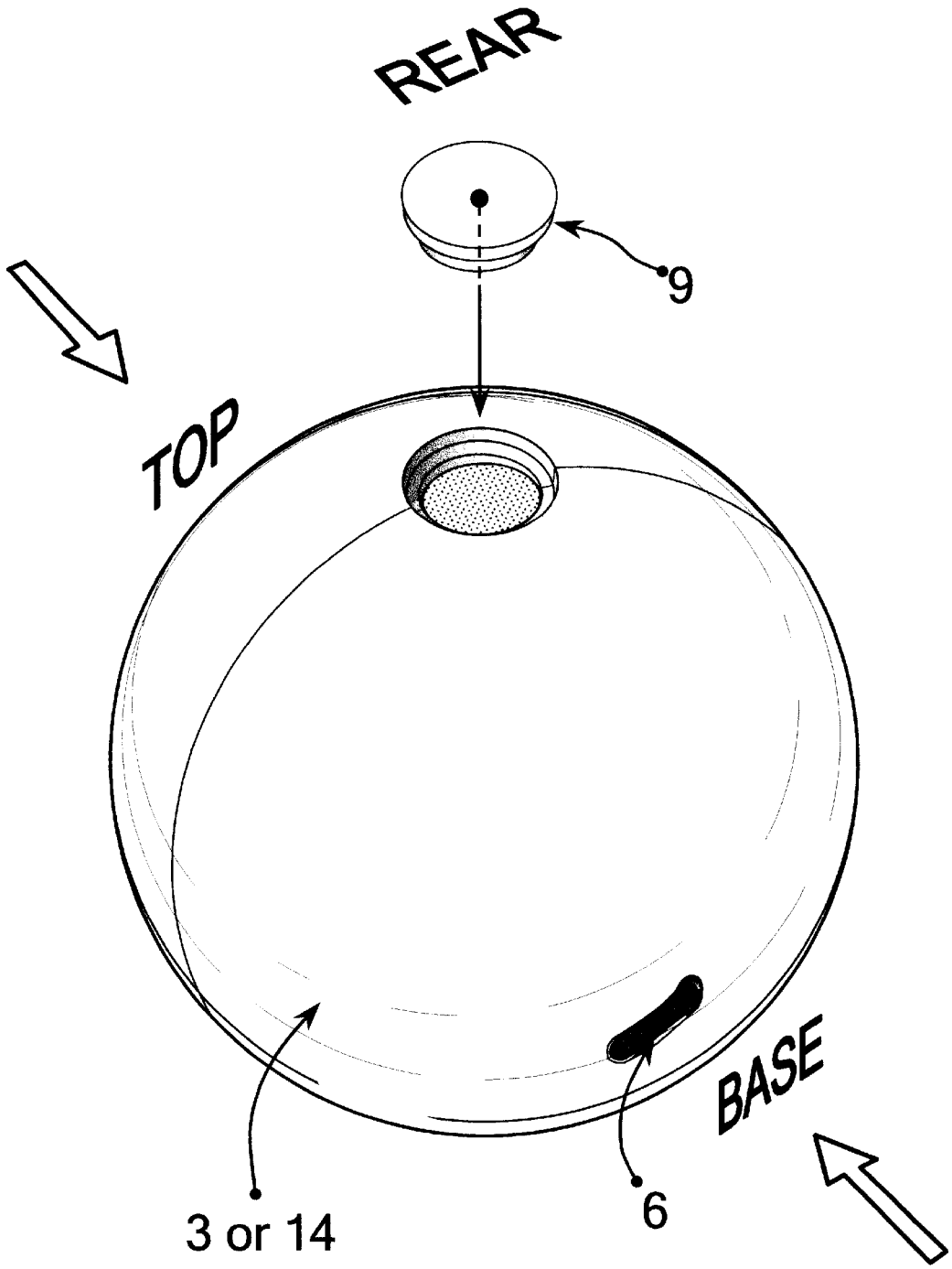
FIG. 4 is an exploded, perspective view locating details at the rear and base of the present invention.

A modification, seen in FIG. 4 of the drawings supplied in this disclosure, is to encase the entire assembly described above within yet another, generally concentric shell 14, much like the first casing, but large enough to enclose a cavity between inner and outer casings, wherein that cavity can be filled with a second fire-extinguishing agent 11, likely dry or liquid, the nature of which could be as a reactant with the dry chemical charge of the inner core, or a second chemical agent to broaden the range of the device against various specialized types of fires, or even the addition of a liquid coolant—even plain water—to increase the fire suppressing efficiency of the device. The use of such coolants is effective due to the sudden expansion of the liquid into fine vapor, thus creating a cooling effect, which is known from many examples of prior art to have a marked effect on many types of fires.

Figure 3:
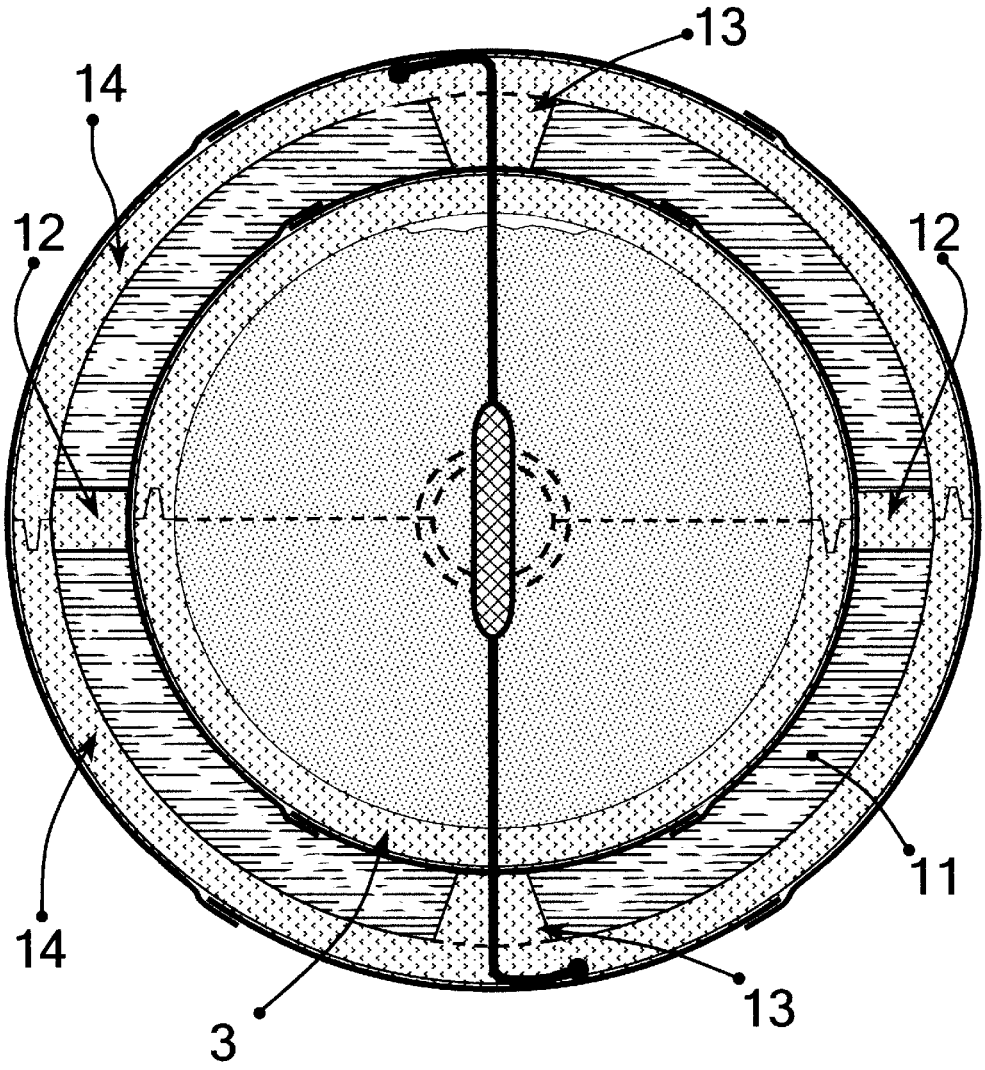
FIG. 3 is a sectional view of a double-walled modification to the basic design of the fire-extinguishing device.

Such 'multi-walled' construction as seen in FIG. 3 is not limited to a second outer casing in the intent of this disclosure. This disclosure contends that in this utility, the number of additional layers, and therefore chambers, that can be enclosed by yet another casing for separation of fire-extinguishing components is only limited to the practical value of the additional complexity of the additional layers. The advancement in the state-of-the-art here is the option of such fire-fighting sophistication and versatility available in a small and simple device that can be assembled at very rudimentary production facilities.

Figure 5:
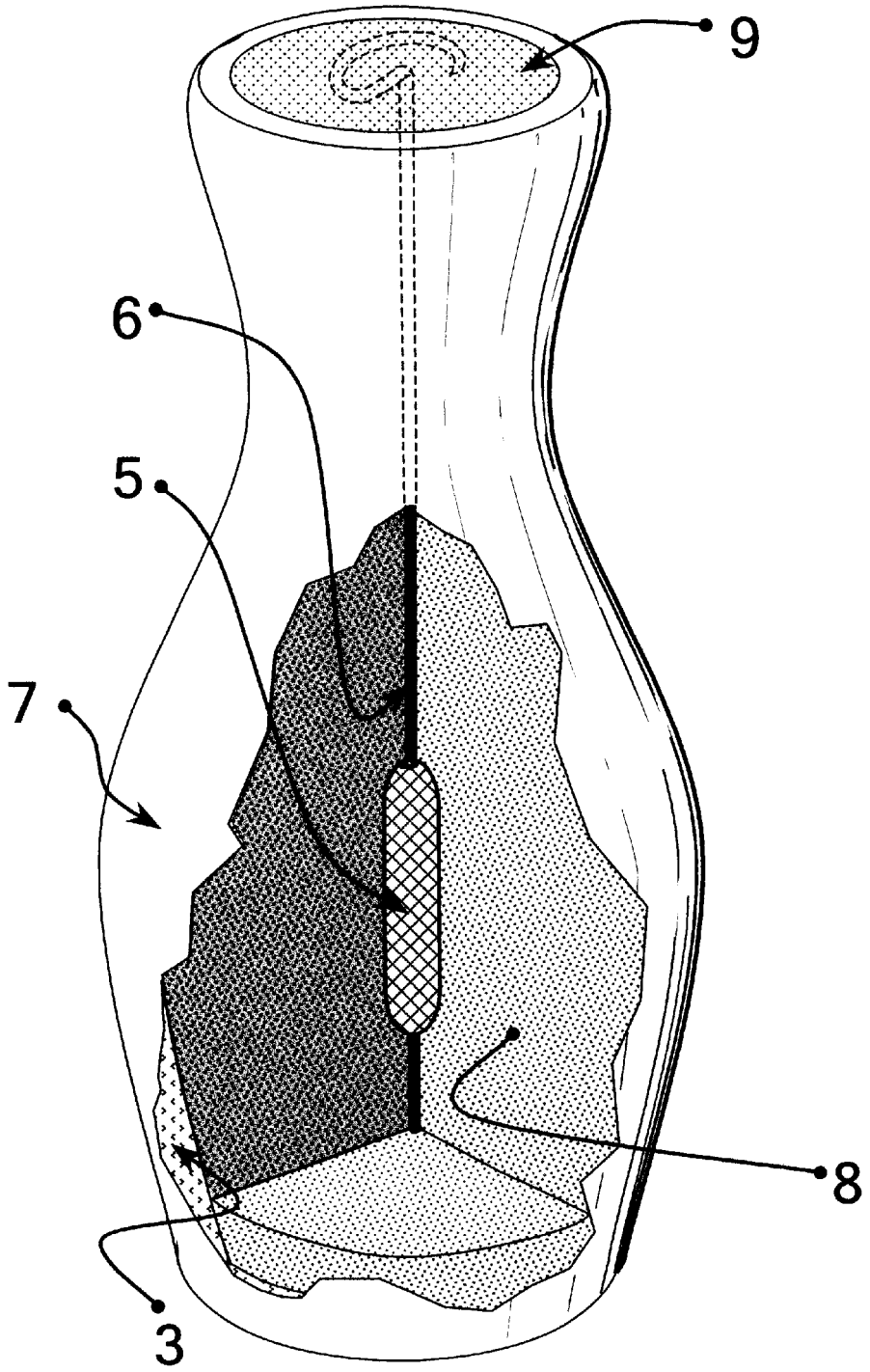
FIG. 5 depicts an alternative external configuration to the basic design of the fire-extinguishing device, being an alteration purely for visual esthetic appeal.

FIG. 5 represents one example of a purely aesthetic alteration in the external profile of the present invention. Such alterations in the shape of the device are not intended to differ from the preferred embodiment's elemental characteristics of a shrink-wrap, plastic film sheathed, rigid foam, hollow casing, enclosing fire-extinguishing agent(s) and a paper or cardboard wrapped pyrotechnic detonator; and therefore, a broad range of external shapes and sizes may be chosen for the utility, as dictated by aesthetics, required interior volume, need for a unique dispersal pattern, or other exigencies.

It should also here be stated that, because of the compactness and low cost of manufacture of the present invention, such devices could conveniently be located at numerous points within buildings, including in the corridors, lavatories and even closets of schools, offices and homes, providing therein a reliable and redundant protection against fires.

With fixed installation of simple bracket holders, the desirable redundancy in self-actuatable operation enhances the device's ability to provide protecting by virtue of the pyrotechnic fuse and detonator, which permit the device to function spontaneously while placed statically on a bracket or holder without need of user intervention. Additionally, there is another inherent safety factor in the moderately loud audible burst upon detonation, which, if the device is self-actuated, suffices as a warning alarm, independent of other sensing devices or centralized systems using electronic circuitry.

The intuitively simple method of manual use requires less dexterity or forethought under tense, stressful conditions, increasing the likelihood of proper and effective use by unpracticed users. In cases where the blaze has advanced to the point of fuel sources and/or other fixtures having absorbed sufficient heat to smolder and re-ignite fires after initial flame suppression by any type of fire-extinguishing equipment, a small quantity of these devices are portable enough that they may be employed to help clear a path of exit out of an engulfed structure. As a 'disposable', single use device, when manual deployment is elected, projecting the device into a blaze is procedurally quicker, more basic and natural than the releasing of safety locks, setting of timers, opening valves or switches, operating triggers and/or directing of sprayed suppressants into the variable areas to fight the blaze, as in some prior art of one form or another. While those systems are not overly complex, it is widely known that victims of fires, even partially incapacitated by heat and/or smoke, and aware that they are in a life-threatening situation, may have difficulty with even simple tasks, wherein their mental faculties may thus be impaired.

What is claimed is:

1. A fire extinguishing device comprising:

a frangible containment vessel formed from a low-density, rigid plastic foam;

a fire extinguishing material contained within the containment vessel; and an explosive device contained within the containment vessel, whereby activation of the explosive device breaks the containment vessel and disperses the fire extinguishing material.

2. The fire extinguishing device of claim 1, wherein the containment vessel comprises a substantially spherical body formed from two complimentary half-sections.

3. The fire extinguishing device of claim 2, wherein the containment vessel further comprises a plastic sheet material substantially encasing the spherical body to securely hold together the two complimentary half-sections.

4. The fire extinguishing device of claim 3, wherein the plastic sheet material comprises shrink-wrap film.

5. The fire extinguishing device of claim 1, wherein the containment vessel comprises an opening through which the fire extinguishing material is introduced into the containment vessel.

6. The fire extinguishing device of claim 4, wherein the plastic foam comprises expanded polystyrene foam.

7. The fire extinguishing device of claim 4, wherein the plastic foam comprises polystyrene foam.

8. The fire extinguishing device of claim 1, wherein the plastic foam comprises expanded polystyrene foam.

9. The fire extinguishing device of claim 1, wherein the explosive device comprises a pyrotechnic detonator.

10. The fire extinguishing device of claim 1, wherein the fire extinguishing material comprises a dry powder-type material.

11. The fire extinguishing device of claim 1, wherein the fire extinguishing material comprises ammonium phosphate.

12. The fire extinguishing device of claim 1, wherein the fire extinguishing material comprises sodium carbonate.

13. The fire extinguishing device of claim 1, wherein the containment vessel has an interior that defines first and second compartments configured to contain first and second types, respectively, of the fire extinguishing material.

14. The fire extinguishing device of claim 2, wherein the containment vessel comprises:

a second substantially spherical body formed from the two complimentary half-sections, the second body being disposed concentrically within the first body, wherein:

a first chamber configured to hold a first type of the fire extinguishing material is defined between the first body and the second body, a second chamber configured to hold a second type of the fire extinguishing material is defined within the second body, and the explosive device is disposed within the second chamber.

15. The fire extinguishing device of claim 1, wherein the explosive device comprises an explosive having insufficient yield to deliver a debilitating concussive shock to humans at close proximity.

16. A fire extinguishing device comprising:

a frangible housing;

means for substantially encasing the housing;

an explosive device that is harmless to an auditory system of a human in proximity of the explosive device when the explosive device is detonated, the explosive device being located in the housing; and fire extinguishing material located in the housing and substantially surrounding the explosive device;

wherein the housing is formed of material that will fragment upon detonation of the explosive device, and wherein the fragmentation is harmless to a human in close proximity to the fire extinguishing device during detonation;

wherein the detonation disperses the fire extinguishing material.

17. The fire extinguishing device of claim 16, wherein the housing comprises first and second complimentary sections that mechanically interconnect.

18. The fire extinguishing device of claim 16, wherein the means for substantially encasing comprises a plastic sheet material.

19. The fire extinguishing device of claim 16, wherein the means for substantially encasing is configured to waterproof the housing.

20. The fire extinguishing device of claim 16, wherein the housing is shaped to uniformly disperse the fire extinguishing material after detonation of the explosive device.

21. The fire extinguishing device of claim 16, wherein the housing is made from a low-density, rigid plastic foam.

22. The fire extinguishing device of claim 16, wherein the housing includes first and second compartments that hold first and second types of the fire extinguishing material.

23. A method for extinguishing a fire without harm to humans proximate to a fire extinguishing device, the method comprising:

providing the fire extinguishing device that comprises a frangible containment vessel formed from a low-density, rigid plastic foam, a fire extinguishing material contained within the containment vessel, and an explosive device contained within the containment vessel; and activating the explosive device with the fire without requiring human intervention, whereby activation of the explosive device breaks the containment vessel and disperses the fire extinguishing material.

* * * * *